United States Patent [19]

Burchett

[11] Patent Number: 4,634,395

[45] Date of Patent: Jan. 6, 1987

[54] INFLATABLE ELASTOMERIC BALLOONS HAVING INCREASED BUOYANT LIFETIMES

[76] Inventor: Donald Burchett, 616 Rymer Way, Louisville, Ky. 40223

[21] Appl. No.: 592,229

[22] Filed: Mar. 22, 1984

[51] Int. Cl.[4] ..... A63H 3/06

[52] U.S. Cl. ..... 446/222; 427/230; 427/231; 428/12; 428/492; 446/220

[58] Field of Search ..... 446/220, 221–226; 244/31; 428/12, 492; 427/230, 231

[56] References Cited

U.S. PATENT DOCUMENTS

| | | | |
|---|---|---|---|
| 1,793,075 | 2/1931 | Flowers . | |
| 1,801,666 | 4/1931 | Geer . | |
| 1,858,460 | 5/1932 | Ranseen . | |
| 2,061,522 | 11/1936 | Shively | 428/492 X |
| 2,295,708 | 9/1942 | Bitter | 446/220 |
| 2,342,580 | 2/1944 | Hartz | 427/230 X |
| 2,391,986 | 1/1946 | Leach | 428/492 X |
| 2,523,312 | 9/1950 | Leboime et al. | 154/46 |
| 2,646,370 | 7/1953 | Nelson | 117/94 |
| 2,701,935 | 2/1955 | Florence | 46/86 |
| 2,860,801 | 11/1958 | Nielsen | 427/230 X |
| 2,929,110 | 3/1960 | Nickerson et al. | 18/58.7 |
| 3,108,396 | 10/1963 | Dorman | 46/90 |
| 3,110,610 | 11/1963 | Goodell | 427/230 X |
| 3,140,969 | 7/1964 | Sharenow | 156/268 |
| 3,149,017 | 9/1964 | Ehrreich et al. | 161/36 |
| 3,182,932 | 5/1965 | Winker | 244/31 |
| 3,184,742 | 5/1965 | Cutler | 343/18 |
| 3,294,577 | 12/1966 | Mayer | 427/230 X |
| 3,415,767 | 12/1968 | Kelly | 244/31 |
| 3,465,471 | 9/1969 | Friedman | 46/44 |
| 3,475,201 | 10/1969 | Hundt et al. | 244/31 |
| 3,519,530 | 7/1970 | Struble, Jr. | 244/31 |
| 3,533,870 | 10/1970 | MacKay et al. | 156/180 |
| 3,559,330 | 2/1971 | Matlack | 46/44 |
| 3,561,579 | 2/1971 | Allison | 194/1 |
| 3,591,975 | 7/1971 | Terc | 46/87 |
| 3,608,903 | 9/1971 | Cooper | 273/135 R |
| 3,609,949 | 9/1971 | Underwood | 244/31 |
| 3,611,623 | 10/1971 | Copstead | 446/220 |
| 3,626,052 | 12/1971 | Sisco | 244/31 |
| 3,662,487 | 5/1972 | Seefluth | 46/44 |
| 3,693,266 | 9/1972 | Pressman | 35/19 R |
| 3,727,229 | 4/1973 | Clinger et al. | 343/706 |
| 3,766,108 | 10/1973 | Liwa et al. | 260/23 R |
| 3,769,070 | 10/1973 | Schilt | 427/230 |
| 3,805,442 | 4/1974 | Matlack | 46/44 |
| 3,859,119 | 1/1975 | Fletcher | 427/231 |
| 3,870,298 | 3/1975 | Varga | 273/1 R |
| 3,933,723 | 1/1976 | Grenness | 260/33.6 A |
| 3,939,509 | 2/1976 | Moore | 9/8 R |
| 3,959,197 | 5/1976 | Salyer et al. | 260/2.5 E |
| 3,959,917 | 6/1976 | Dawson | 46/74 D |
| 3,972,526 | 8/1976 | Cox, Jr. | 272/1 D |
| 3,999,751 | 12/1976 | Scardino | 272/31 R |
| 4,023,816 | 5/1977 | Ellman et al. | 280/1.13 |
| 4,027,402 | 6/1977 | Liu et al. | 35/9 R |

(List continued on next page.)

OTHER PUBLICATIONS

Brage Golding, "Polymers & Resins", Copyright 1959, See pp. 558–569.

Diffusion in Polymers, Eds: J. Crank & G. S. Park, Academic Press: London and New York, pp. 62–64 (1968).

Handbook of Common Polymers, The Chemical Rubber Co., Ed.: W. J. Roff, J. R. Scott, and J. Pacitti, Butterworth & Co.: London, Section 7: 72–78 (1971).

*Primary Examiner*—F. Barry Shay

*Attorney, Agent, or Firm*—Wood, Herron & Evans

[57] ABSTRACT

A composition and method and apparatus for increasing the buoyant lifetime of a gas inflatable elastomeric balloon wherein a surface of a balloon is coated with an aqueous solution containing 3 to 50 percent polyvinyl alcohol, and up to 20 percent of a water soluble plasticizer for polyvinyl alcohol such as glycerine, which coating is dried while the balloon is in the inflated condition. Treatment of a rubber latex balloon having an inflated diameter of about 15 cm to about 50 cm by the method of this invention can increase its buoyant lifetime about 600 percent without significantly changing the appearance of the balloon.

44 Claims, 6 Drawing Figures

OTHER PUBLICATIONS

| | | | |
|---|---|---|---|
| 4,033,137 | 7/1977 | Geist | 61/1 F |
| 4,035,149 | 7/1977 | Scott et al. | 21/60.5 R |
| 4,038,777 | 8/1977 | Schwartz | 46/87 |
| 4,047,324 | 9/1977 | Wesenberg | 46/86 R |
| 4,077,588 | 3/1978 | Hurst | 446/226 |
| 4,084,771 | 4/1978 | Creuzet | 244/31 |
| 4,092,798 | 6/1978 | Oquita | 46/11 |
| 4,094,299 | 6/1978 | Voelker | 126/270 |
| 4,119,604 | 10/1978 | Wysong | 428/220 X |
| 4,120,259 | 10/1978 | Wilson | 116/124 |
| 4,125,506 | 11/1978 | Lundberg et al. | 260/30.6 R |
| 4,143,185 | 3/1979 | Lundberg et al. | 427/314 |
| 4,145,838 | 3/1979 | Mason | 46/11 |
| 4,149,338 | 4/1979 | Wolf | 46/44 |
| 4,196,236 | 4/1980 | Lundberg et al. | 427/374 B |
| 4,208,469 | 6/1980 | Dial | 428/315 |
| 4,232,477 | 11/1980 | Lin | 46/88 |
| 4,243,220 | 1/1981 | Shelley | 273/1 R |
| 4,267,989 | 5/1981 | Skaggs | 244/31 |
| 4,268,030 | 5/1981 | Richards | 272/77 |
| 4,290,763 | 9/1981 | Hurst | 493/341 |
| 4,292,999 | 10/1981 | Szollmann | 137/560 |
| 4,305,501 | 12/1981 | Collette | 206/457 |
| 4,307,537 | 12/1981 | Bergmann | 46/87 |
| 4,336,662 | 6/1982 | Baird | 37/54 |
| 4,361,625 | 11/1982 | Beckman et al. | 428/412 |
| 4,391,063 | 7/1983 | Gill | 46/90 |
| 4,428,149 | 1/1984 | Brown | 46/90 |
| 4,441,719 | 4/1984 | Lohr | 273/402 |
| 4,470,218 | 9/1984 | Yu | 446/220 |
| 4,486,975 | 12/1984 | Harreld et al. | 446/220 |
| 4,534,525 | 8/1985 | Bliamptis | 244/30 |
| 4,547,167 | 10/1985 | Bergmann | 446/220 |
| 4,547,168 | 10/1985 | Blacksberg et al. | 446/222 |

FIG.1A
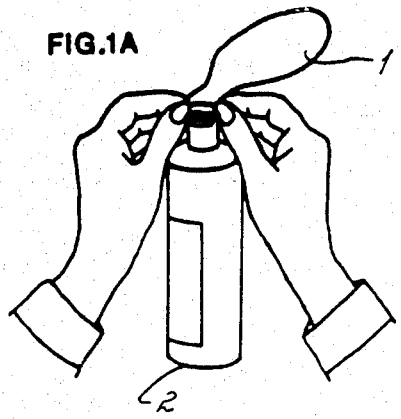
FIG.1B
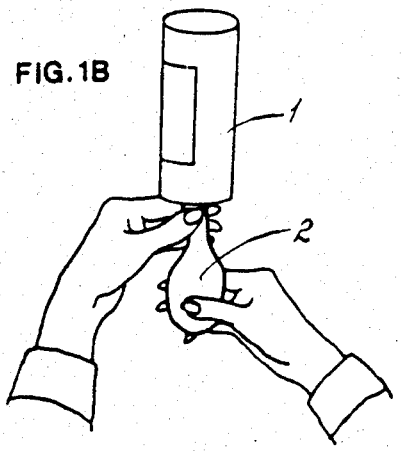
FIG.1C
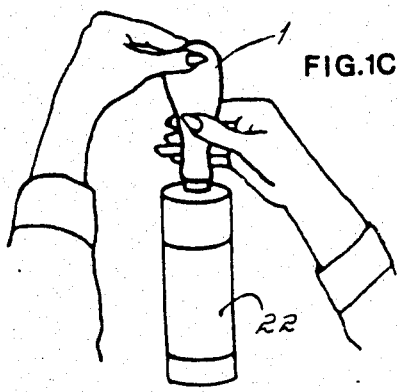
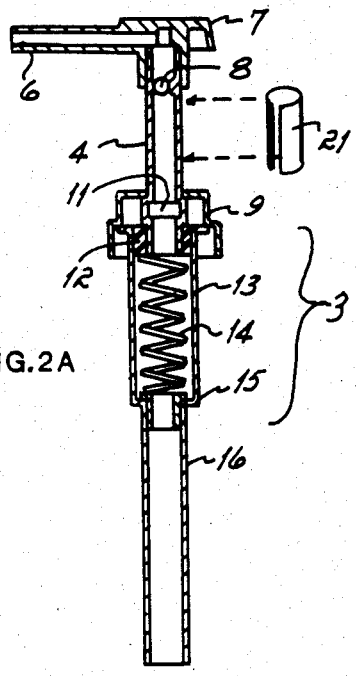
FIG.2A
FIG. 2B
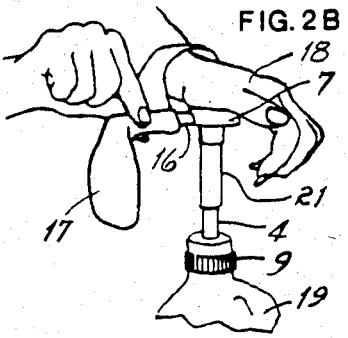
FIG. 2C
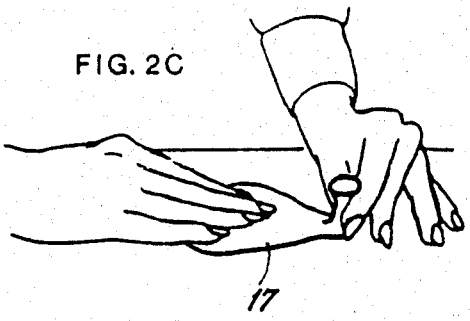

INFLATABLE ELASTOMERIC BALLOONS HAVING INCREASED BUOYANT LIFETIMES

BACKGROUND OF THE INVENTION

1. Field of the Invention

This invention relates to elastomeric balloons that are filled with gas which can be lighter than air, such as helium. More specifically, this invention relates to a method for treating inflatable elastomeric balloons to increase their buoyant lifetime.

2. Description of the Prior Art

Small toy balloons having an inflated diameter ranging from about 15 cm to about 50 cm are conventionally made by filling a brightly colored elastomeric envelope with helium gas. Such lighter than air balloons have been widely sold and used for a number of years at places like circuses, fairs, toy stores, and the like. Another common use for such balloons is for advertising purposes wherein a logo or advertising message is printed on the outside surface of the balloon. In more recent years there has been a proliferation of balloon greeting serive companies who, for a fee, deliver bunches of helium inflated elastomeric balloons, usually conveying a personal message, to individuals on birthdays, anniversaries, Valentines Day, or other special occasions. Another popular use for this balloon delivery service is to send a get well message with up to a dozen helium inflated balloons to an adult or child who is convalescing from an illness in a hospital or other institution. A major problem with such prior art helium filled elastomeric balloons is that they do not remain buoyant for very long; their typical buoyant lifetime ranges from a few hours to a day or so. This short buoyant lifetime is due to the diffusion of the very small helium atoms through the elastomeric envelope provided by the balloon. Because of the short buoyant lifetime, such balloons must be inflated at the time of sale or just piror to sale. They cannot be inflated in advance and stocked for use when needed.

Accordingly, over the years various attempts have been made to develop envelope materials for lighter than air balloons which have decreased permeability to inflation gasses such as helium. Methods have been developed for making large meteorological and aeronautical balloons having volumes of 3000 L. or more which have very long buoyant lifetimes. Due to the small surface-to-volume ratio of such large balloons, the envelope materials can be made relatively thick and heavy without affecting their long term buoyancy. For example, methods for making laminated envelopes for meteorological and aeronautical balloons wherein one or more gas impermeable layers, typicall metal sheet or foil, are used in combination with layers of cloth, rubber, cellulose, paper, or leather are disclosed in German Pat. Nos. 219,440; 224,521; 227,150; 515,083; and U.S. Pat. Nos. 1,793,075 and 1,801,666. Again, the thick walled envelopes resulting from these methods have a relatively high weight per unit of surface area and cannot be successfully scaled down to the smaller size of typical toy and advertising balloons.

U.S. Pat. Nos. 3,149,017 and 3,608,849 disclose using non-elastic materials such as biaxially oriented polyethylene in making the envelopes for large meteorlogical balloons. Again, the thick wall required for satisfactory retention of helium rules out its use in the smaller toy and advertisting balloons.

A recent attempt to solve the problem of short buoyant lieftime of small balloons is disclosed in U.S. Pat. No. 4,077,588 wherein the balloon envelope is fabricated from a seamed panel of nonelastic polymer having a vapor deposited metal coating. Experience in using balloons manufactured by this method, commonly known as "Mylar" TM (DuPont Co.) balloons, has revealed a number of serious problems. Typically, "Mylar" balloons cost about 10 times as much as elastomeric balloons of equivalent size. Since the "Mylar" balloons are nonelastic, they are inflated with helium to about atmospheric pressure; even a slight overinflation causes the seams to rupture since these balloons cannot expand elastically. Morover, these balloons are extremely temperature sensitivie. A "Mylar" balloon inflated at room temperature often generates sufficient internal pressure to rupture the seam if the balloon is moved to a location where the temperature is warmer such as out of doors on a warm day. Similarly, a "Mylar" balloon inflated at room temperature will deflate partially and become non-buoyant when moved to a cooler location. Another problem with the "Mylar" balloon is that it must be heat sealed after inflation; this is a time consuming step requiring special equipment and can be expensive.

U.S. Pat. Nos. 2,646,370 and 3,415,767 disclose methods for plasticizing neoprene synthetic rubber used in making meteorological balloons in order to improve the low temperature elastic properties at high altitudes.

SUMMARY OF THE INVENTION

The present invention provides a method for treating inflatable elastomeric balloons to increase the buoyant lifetime by coating the surface of the balloon with an aqueous solution containing 3 to 50 percent by weight polyvinyl alcohol, and up to 20 percent by weight of a water soluble plasticizer for polyvinyl alcohol, which coating is dried while the balloon is in the inflated condition. Treatment by the method of this invention typically has been found to give a 600 percent increase in the buoyant lifetime of the balloon without changing its appearance. This invention now provides a safe, convenient, and relatively inexpensive method of solving the old problem of short buoyant lifetimes of helium filled elastomeric toy and advertising balloons. In addition this invention provides a means whereby a balloon merchant can now inflate such balloons in advance of periods of heavy demand, such as Valentines Day, and store them until needed. Heretofore this has not been possible.

While one procedure within the scope of the present invention is dislcosed with reference to the accompanying drawings it will be understood that other procedures, apparatus, and methods also within the scope of the present invention will occur to those skilled in the art upon reading the disclosure set forth hereinafter.

BRIEF DESCRIPTION OF THE DRAWINGS

With reference to the accompanying drawings which illustrate one method and apparatus within the scope of the present invention:

FIGS. 1A–1C illustrate one method of applying coating solutions to balloons within the scope of the present invention; and FIGS. 2A–2C illustrate another method and apparatus for application of coating solutings to balloons.

DETAILED DESCRIPTION OF THE INVENTION

In accordance with a method of the present invention, a solution is prepared by dissolving polyvinyl alcohol and a water soluble plasticizer for polyvinyl alcohol in water.

In one example of the plasticizer is added first to cold water. Next the polyvinyl alcohol solids are slowly sprinkled into the vortex formed by rapidly stirring the water/plasticizer solution, and the rapid stirring is continued for about 10 minutes in order to thoroughly wet and disperse the solids. Heat is then supplied by means of an immersed hot water coil to warm the slurry to about 90° C. in order to solubilize the polyvinyl alcohol. During this heating step the rate of agitation is slowed in order to avoid shear degradation of the polymer. The heating step is continued for about 4 hours until the polyvinyl alcohol is completely dissolved.

It has been found that the concentration of polyvinyl in the above solution can range from as little as about 3 percent by weight to as high as about 50 percent by weight as discussed hereinafter. It has further been found that concentrations of polyvinyl alcohol less than 3 percent by weight do not give the desired increase in buoyant lifetime unless multiple coatings are employed. Conversely, higher concentrations of polyvinyl alcohol become too viscous to pour freely at room temperature. In any event it is recognized that the concentration of polyvinyl alcohol which yields a flowable solution is a function of the average molecular weight of the polyvinyl alcohol utilized; higher concentrations are possible when using lower molecular weight polymers. In one preferred embodiment, polyvinyl alcohol having a weight average molecular weight of about 96,000 is used at the concentration of about 12 to 17 percent by weight. This combination was experimentally determined to give a good balance between the viscosity of the solution and the buoyant lifetime of the treated balloon.

While it has been found that elastomeric balloons treated with solutions containing only polyvinyl alcohol and water exhibit the sought increase in buoyant lifetime, the balloons underwent an undesirable change in appearance. Namely, these balloons developed surface wrinkles within a day or two after inflation with helium and the wrinkling became progressively worse on aging the inflated balloons. For example, after five or six days the balloons were severely puckered and disfigured. While the material performed satisfactory from a functional standpoint the wrinkling is aesthetically objectionable and also makes any writing on the balloon illegible. It was discovered that the wrinkling characteristics can be greatly reduced or eliminated by adding up to 20 percent by weight of a water soluble plasticizer for polyvinyl alcohol to the solution. Increasing the concentration of plasticizer beyond the optimum concentration was found to decrease subsequent wrinkling of the balloon, but was also found to decrease the buoyant lifetime of the balloon when compared to using unplasticized polyvinyl alcohol. Therefore the optimum concentration of plasticizer is one that is sufficient to eliminate wrinkling. While several plsticizers were found to be useful glycerine was found to be very effective at preventing wrinkling at concentrations low enough to still give a major increase in buoyant lifetime. In the preferred embodiment of the present invention glycerine is added to the polyvinyl alcohol solution to give a concentration of about 3 to 4 percent by weight of glycerine.

In one method of the present invention illustrated in FIGS. 1A–1C the solution of polyvinyl alcohol and glycerine is used to coat the surface of an elastomeric balloon by filling the balloon with the solution and then draining to leave a uniform coating on the inside surface. As shown in FIG. 1A a balloon 1 can be attached over the neck of a bottle 2 containing the above described solution. The assembly is then inverted as shown in FIG. 1B so the balloon 1 is allowed to fill with the solution. As shown in FIG. 2C the bottle is then turned upright and the excess solution drained into the bottle by collapsing the sides of the balloon on each other.

Using this coating method typically results in depositing about 7 to 10 gms of solution in a balloon having an inflated diameter of about 28 cm. Obviously, larger balloons will retain more liquid and smaller balloons will retain less liquid when treated by this method.

Following this coating step, the balloon is inflated with a gas, for example helium, in the usual manner while the coating is still wet. The liquid on the inside surface of the balloon expands as the balloon is inflated to give a very thin, uniform coating. This coating is then allowed to dry with the balloon in the inflated condition. Drying occurs by evaporation of water from the coating film into the helium gas phase, and also by diffusion of moisture through the elastomeric wall of the balloon. This drying is achieved in a few hours at room temperature.

FIGS. 2A–2C present an example of another coating method within the scope of the present invention using a pump assembly 3. A plunger 4 is provided having an outlet spout 6 communicating with plunger 4 through a hand rest 7 which contains a check valve 8 to prevent fluid flow from spout 6 to plunger 4. Plunger 4 is received in a neck assembly 9 and retained therein by collar 11. Neck assembly 9 can be threaded to be received on a bottle 19 of the solution described previously as shown in FIG. 2B. Plunger 4 also includes a piston 12 received in a housing 13 where a return spring 14 is provided as shown. A tube 16 is provided to an inlet/outlet part 15 of housing 13 to extend into the liquid to be pumped.

In operation plunger 4 is depressed, for example by pressure applied by the hand 18 of the user, as shown in FIG. 2B, with a balloon 17 in place on spout 6. The solution is forced from bottle 19 through tube 16 and check valve 8 into balloon 17.

In accordance with another feature of the present invention it has been found that the quantity of fluid admitted to the balloon can be easily controlled by use of collar 21 received on plunger 4 to limit movement of the plunger and piston 12 in chamber 13. As shown, collar 21 is adopted to be "snapped" onto plunger 4 so that the downward movement of the plunger emitted from spout 6 is controlled by the length of collar 21. Thus for larger balloons a shorter collar is utilized than for smaller balloons. After the proper amount of fluid has been admitted to the balloon 17 the solution is then applied to the entire inner surface as shown in FIG. 2C by rubbing opposite sides of the balloon together.

In the present invention the wet coating is usually dried while the balloon is inflated in order for the resulting polyvinyl alcohol film to have the same dimensions as in the inflated balloon. If the wet coating is allowed to dry while the balloon is deflated, subsequent inflation of the balloon with helium may rupture the inelastic polyvinyl alcohol film and tear it away form the expanding elastic balloon surface.

Coating the inside surface of the balloon has the advantage of enabling the balloon to be used or otherwise handled as soon as it is inflated. It is not necessary to wait for the coating to dry.

Placing the coating on the outside surface of the balloon requires the coating to be dried before the balloon can be used or decorated with writing. Also, an outside coating is susceptible to damage from rain since the coating materials are water soluble. However, in some cases it may still be desirable to place the coating on the outside surface since this helps protect the balloon from accidential bursting if brushed against a sharp object.

The elastomeric material utilized to make the inflatable balloons of this invention may be comprised of rubber latex.

Various grades of polyvinyl alcohol work in the present invention, for example, higher or lower average molecular weight polymer can be used. Also, the polyvinyl alcohol may be only partially hydrolized and contain substantial amounts of residual acetate. In the preferred embodiment of the present invention polyvinyl alcohol is used which has a weight average molecular weight of about 96,000 and a residual acetate content of about 20 to 25 percent.

In addition to glycerine, other water soluble plasticizers for polyvinyl alcohol will work in the present invention. For example, in one experiment is was found that adding 4 to 5 percent by weight propylene glycol to the treatment solution effectively prevented surface wrinkling in the treated balloon. Other plasticizers commonly used for polyvinyl alcohol would also be satisfactory, for example ethylene glycol, butylene glycol, sorbitol, diglycerol, low molecular weight polyethylene glycols, ethanolamine salts, sodium or ammonium thiocyanate, ethanol acetamide, and ethanol formamide.

Although the preferred embodiment involves drying the coating solution by suspending the inflated balloon in air at room temperature, it is obvious that this drying step can be accelerated by using heated air, microwave radiation, infrared radiation, and other known means of heating a film for the purpose of drying.

It should be clear that other methods of applying the coating solution to the elastomeric surface of the balloon will also work. For example, the coating solution can be dispursed as fine droplets in the gas used to inflate the balloon through the use of a suitable gas/liquid spray nozzle. If coating the outside surface of the balloon is desired, this can be achieved by using a spray nozzle to disperse the solution in the air spray. Alternatively, the outside surface of the balloon can be coated by dipping the uninflated balloon into a container of the solution.

In another embodiment the inside surface is coated and the balloon is then sealed while still uninflated by means of a removable clamp to prevent the inside coating from drying during storage. A number of such clamps intended for the purpose of sealing balloons are known in the art and readily available from balloon suppliers. The balloon thus sealed may be stored for an indefinite period of time. When needed, the clamp is removed and the balloon is inflated then resealed using the same clamp. After inflation the coating is allowed to dry by the means discovered hereinbefore. Using this approach it is possible for the coating to be done by the balloon manufacturer, and the drying step to be done by the balloon merchant.

It should be clear that other ingredients can be added to the treating solution without substantially altering the manner in which it functions to obtain the desired result. For example, small amounts of mold preventing additives can be used to increase the shelf life of the solution. These include chemicals such as "Myconban" TM (Pfiger, Inc.) or "Dowicide" TM (Dow Chemical Co.) added at levels up to 0.5 percent by weight. Also, the formation of undersirable gel in the treating solution can be inhibited through the addition of up to 0.3 percent by weight "Triton" X100 TM (Rohm & Haas Co.). The viscosity of the treating solution can be lowered somewhat by the addition of up to 3 percent by weight of hydrogen peroxide.

A few methods in accordance with the present invention will now be further illustrated by reference to the following examples.

EXAMPLE 1

An aqueous solution containing 15 percent by weight polyvinyl alcohol "Gelvatol" 20/60 TM (Monsanto Chemical Co.) and 3.25 percent by weight solution of glycerine in water is prepared by slowly adding "Gelvatol" powder to the cold glycerine solution with rapid stirring to thoroughly wet and disperse the solids. The rate of stirring is then slowed and the solution is heated to about 90° C. and held at this temperature for about 4 hours until the solids are completely dissolved. The resulting solution is then cooled to room temperature.

An elastomeric toy balloon having an inflated diameter of about 28 cm is treated by filling it with the above solution and draining it to leave an internal surface coating weighing about 8 to 10 gms. While this coating is still wet, the ballon is inflated using pressurized helium and tied in the usual manner.

Within a few hours at room temperature the coating solution inside the balloon dries to leave a thin film weighing about 1.8 gms and having the composition of about 80 percent polyvinyl alcohol and about 20 percent glycerine. The dried film is optically clear and is distributed evenly over the inside surface of the inflated balloon.

The buoyant lifetime of the balloon is then determined by suspending the balloon on the end of a 30 cm length of light string and measuring the elasped time from the point of inflation with helium until the point when balloon is no longer buoyant enough to supports its own weight. Ten balloons treated by the method in this example were found to have buoyant lifetimes ranging from 144 hrs to 216 hrs with an average lifetime of 165 hrs. One week after inflation the surfaces of the test balloons were smooth and free of wrinkles.

Ten control balloons of the same size were not treated and were found to have a buoyant lifetime average of 24 hours. Therefore treatment by the above method resulted in an average increase in buoyant lifetime of 688 percent without changing the appearance of the balloons.

EXAMPLE 2

The solution of Example 1 is injected into a helium gas stream at the rate of about 0.3 gm of solution per liter of gas using a conventional gas liquid mixing nozzle. This stream is used to inflate a 28 cm diameter elastomeric balloon thereby coating the inside of the balloon with liquid. The balloon is then suspended in air at room temperature for several hours to allow the inside coating to dry. Treatment by this method gives approximately the same increase in buoyant lifetime seen in Example 1. Again, the appearance of the balloon is not changed by the treatment.

EXAMPLE 3

A 28 cm diameter elastomeric balloon is treated by injecting approximately 9 gms of the solution of Example 1 through the balloon's opening, and the opening is then sealed using a small plastic clip of which several types are commercially available for the purpose of sealing balloons.

The balloon thus sealed is tumbled inside a slowly revolving horizontal drum. The action of the drum repeatedly lifts the balloon a short distance into the air and allows it to fall. This tumbling action gently works the elastomeric balloon envelope thereby spreading the coating uniformly over the inside surface. After tumbling for approximately 30 minutes the balloon is placed in a plastic bag and stored for several weeks. Following this storage period the sealing clip is removed and the balloon is inflated with helium. After inflation the sealing chip used earlier is again used to seal the balloon. The coating inside the balloon is dried by suspending the inflated balloon in air for serveral hours at room temperature.

Treatment by this method gives approximately the same increase in buoyant lifetime seen in Example 1, again without significantly changing the appearance of the balloon.

It will be understood that the foregoing are but a few examples of procedures and compositions within the scope of the present invention and that various other compositions and procedures within the scope of the present invention will occur to those skilled in the art upon reading the disclosure set out hereinbefore.

The invention claimed is:

1. A method of increasing the buoyant lifetime of a gas inflatable balloon when the balloon is in an inflated condition, the balloon comprising an elastomeric material having inside and outside surfaces, said method comprising coating at least one of said surfaces with a solution which comprises about 3 to about 50 percent by weight a polyvinyl alcohol and about 50 to about 97 percent by weight water.

2. A method as in claim 1 wherein the solution further comprises up to about 20 percent by weight of a water soluble plasticizer.

3. A method as in claim 2 wherein the water soluble plasticizer is selected from the class consisting of glycerine, ethylene glycol, propylene glycol, butylene glycol, sorbitol, diglycerol, low molecular weight polyethylene glycols, ethanolamine salts, sodium or ammonium thiocyanate, ethanol acetamide and ethanol formamide.

4. A method as in claim 1 wherein the polyvinyl alcohol is partially hydrolized.

5. A method as in claim 1 further comprising drying the solution while the balloon is in an inflated condition.

6. A method as in claim 1 wherein the solution is applied to the inside surface of the balloon.

7. A method as in claim 1 wherein the solution is applied to the outside surface of the balloon.

8. A method as in claim 6 which after said coating step further includes the step of sealing the coated balloon for preventing the solution from drying during storage of the coated balloon.

9. A method of increasing the buoyant lifetime of an inflatable balloon when the balloon is in an inflated condition, the balloon comprising an elastomeric material having inside and outside surfaces, said method comprising the steps of:

coating at least one of said surfaces with a solution comprising about 12 to about 17 percent by weight a polyvinyl alcohol, about 3 to about 4 percent by weight glycerine, and about 79 to about 85 percent by weight water; and drying the solution while the balloon is in an inflated condition.

10. A method as in claim 9 wherein the solution is applied to the inside surface of said balloon.

11. A method as in claim 9 wherein the solution is applied to the outside surface of said balloon.

12. A method of claims 6 or 9 including the further steps of injecting a selected amount of the solution into the balloon to coat the inside surface using adjustable pumping means; and distributing the solution over the inside surface.

13. A method of increasing the buoyant lifetime of an inflatable balloon when the balloon is in an inflated condition, the balloon comprising an elastomeric rubber latex material having inside and outside surfaces and having an inflated diameter of from about 15 cm to about 50 cm, said method comprising the steps of:

coating at least one of said surfaces of said rubber latex material with a solution comprising about 3 to about 50 percent by weight a polyvinyl alcohol, 0 to 20 percent by weight of a water soluble plasticizer and about 50 to about 97 percent by weight water; and drying the solution while the balloon is in an inflated condition.

14. A method of coating an inflatable elastomeric toy balloon having an inflated diameter of from about 15 cm to about 50 cm with a diffusion barrier film to increase the floating lifetime of the balloon when in an inflated condition, comprising the steps of:

applying a liquid comprising an aqueous solution of a dispersed gas diffusion barrier coating material to a surface of the balloon;

expanding the coated surface by inflating the balloon; and drying the liquid while the balloon is in an inflated condition with said surface expanded.

15. A method of claim 14 wherein the liquid contains a polyvinyl alcohol.

16. An inflatable elastomeric balloon having increased buoyant lifetime when in an inflated condition comprising an elastomeric envelope, said elastomeric envelope having inside and outside surfaces, and a coating on one of said surfaces of said elastomeric envelope comprising about 3 to about 99 percent by weight a polyvinyl alcohol and up to about 40 percent by weight plasticizer.

17. An inflatable elastomeric balloon having increased buoyant lifetime when in an inflated condition comprising an elastomeric envelope having an inside surface, an outside surface and a filling opening, a coating solution on the inside surface of said elastomeric envelope comprising about 3 to about 50 percent by weight a polyvinyl alcohol, 0 to about 20 percent by weight of a water soluble plasticizer and about 50 to about 97 percent by weight water, and means removably attached to said envelope for sealing said opening and for preventing said coating solution from drying.

18. An inflatable air buoyant balloon having increased buoyant lifetime when in an inflated condition comprising an elastomeric envelope having inside and outside surfaces wherein at least one of said surfaces thereof is coated with a coating comprising a polyvinyl alcohol.

19. A balloon as in claim 18 wherein the polyvinyl alcohol is partially hydrolized.

20. A balloon as in claim 18 wherein the coated surface is the inside surface.

21. A balloon as in claim 18 wherein the coated surface is the outside surface.

22. A balloon as in claim 18 wherein the coating further comprises a plasticizer for the polyvinyl alcohol.

23. A balloon of claim 22 wherein the plasticizer is selected from the class consisting of glycerine, ethylene glycol, propylene glycol, butylene glycol, sorbitol, diglycerol, low molecular weight polyethylene glycols, ethanolamine salts, sodium or ammonium thiocyanate, ethanol acetamide and ethanol formamide.

24. An inflatable balloon comprising an elastomeric material, said elastomeric material having inside and outside surfaces adapted to be expanded by inflation of said balloon, and a gas barrier coating on at least one of said surfaces comprising a polyvinyl alcohol.

25. A balloon as in claim 24 wherein the polyvinyl alcohol is partially hydrolized.

26. A balloon as in claim 24 wherein said gas barrier coating further includes a plasticizer.

27. An inflatable balloon comprising an elastomeric envelope, said elastomeric envelope having inside and outside surfaces adapted to be expanded by inflation of said balloon, said balloon being produced by the process of providing a gas barrier coating comprising a polyvinyl alcohol on at least one of said surfaces of said envelope.

28. An inflatable balloon as in claim 27 wherein the polyvinyl alcohol is partially hydrolized.

29. An inflatable balloon as in claim 27 wherein the gas barrier coating further includes a plasticizer for the polyvinyl alcohol.

30. An inflatable balloon as in claim 27 wherein said gas barrier coating is water soluble and is deposited onto the expandable surface as an aqueous solution which is subsequently dried.

31. A closable, non-inflated elastomeric envelope having inside and outside surfaces and a coating on at least one of said surfaces, said elastomeric envelope being inflatable with a lighter-than-air gas to expand said surfaces and provide a buoyant toy balloon having prolonged buoyant lifetime and an inflated diameter of from about 15 cm to about 50 cm when inflated with the gas, said coating comprising a gas barrier dispersed on one of said surfaces of said elastomeric envelope when said elastomeric envelope is inflated, said gas barrier coating being dispersible on one of said surfaces of said elastomeric envelope when said elastomeric envelope is in an uninflated condition and when said elastomeric envelope is being inflated.

32. A toy balloon comprising an elastomeric material and being inflatable to a diameter of from about 15 cm to about 50 cm, said elastomeric material having expandable inside and outside surfaces and a coating on one of said expandable surfaces comprising a gas barrier to enhance the buoyant lifetime of said toy balloon when in an inflated state with said coated surface expanded.

33. A toy balloon as in claim 32 wherein said gas barrier coating is less elastic than the elastomeric material used to form the toy balloon.

34. A toy balloon as in claim 33 wherein said coating comprises a polyvinyl alcohol.

35. A toy balloon as in claim 33 wherein said coating further includes a plasticizer.

36. A toy balloon as in claim 35 wherein said plasticizer is glycerine.

37. A toy balloon as in claim 34 wherein the polyvinyl alcohol is partially hydrolized.

38. An inflatable toy balloon comprising an elastomeric envelope comprised of rubber latex having an inflated diameter of from about 15 cm to about 50 cm, said elastomeric envelope having expandable inside and outside surfaces wherein at least one of said surfaces is coated with a coating comprising a gas barrier substance for enhancing the buoyant lifetime of the toy balloon when it is in an inflated state with said one surface expanded.

39. An inflatable toy balloon as in claim 38 wherein said gas barrier substance comprises a polyvinyl alcohol.

40. An inflatable toy balloon as in claim 39 wherein said coating further includes a plasticizer for the polyvinyl alcohol.

41. An inflatable toy balloon as in claim 40 wherein said plasticizer is glycerine.

42. An inflatable toy balloon as in claim 38 wherein the coated surface is the inside surface.

43. An inflatable toy balloon as in claim 38 wherein the coated surface is the outside surface.

44. An inflatable toy balloon as in claim 39 wherein the polyvinyl alcohol is partially hydrolized.

* * * * *